US006555309B2

(12) United States Patent
Kato

(10) Patent No.: US 6,555,309 B2
(45) Date of Patent: Apr. 29, 2003

(54) METHOD FOR MANUFACTURING PHOTOTHERMOGRAPHIC MATERIALS

(75) Inventor: Akifumi Kato, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/011,772

(22) Filed: Dec. 11, 2001

(65) Prior Publication Data

US 2002/0106595 A1 Aug. 8, 2002

(30) Foreign Application Priority Data

Dec. 13, 2000 (JP) ..... 2000-378607

(51) Int. Cl.[7] ..... G03C 1/00; B05D 1/30

(52) U.S. Cl. ..... 430/620; 430/531; 430/617; 430/935; 430/965; 118/410; 427/420

(58) Field of Search ..... 430/531, 617, 430/620, 935, 965, 619; 118/410; 427/420

(56) References Cited

U.S. PATENT DOCUMENTS

| | | | | |
|---|---|---|---|---|
| 2,761,791 A | | 9/1956 | Russell | |
| 4,113,903 A | | 9/1978 | Choinski | |
| 4,525,392 A | * | 6/1985 | Ishizaki et al. | 427/420 |
| 5,290,660 A | * | 3/1994 | Eian et al. | 430/203 |
| 6,013,327 A | * | 1/2000 | Naruse et al. | 427/420 |

FOREIGN PATENT DOCUMENTS

| | | |
|---|---|---|
| EP | 0 883 022 A1 | 12/1998 |
| GB | 2 029 733 A | 3/1980 |
| GB | 2 070 459 A | 9/1981 |
| WO | WO 99/46640 | 9/1999 |

OTHER PUBLICATIONS

Patent Abstracts of Japan vol. 017, No. 606 (C–1128), Nov. 8, 1993 & JP 05 185007 A (Fuji Photo Film Co Ltd), Jul. 27, 1993.

Patent Abstracts of Japan vol. 2000, No. 11, Jan. 3, 2001 & JP 2000 225368 A (Konica Corp), Aug. 15, 2000.

* cited by examiner

*Primary Examiner*—Thorl Chea
(74) *Attorney, Agent, or Firm*—Sughrue Mion, PLLC

(57) ABSTRACT

In the case where multiple slide hopper is used for simultaneous multilayer bead coating of photosensitive material, streak defect is occasionally cause, particularly in the case of coating photothermographic material, especially when the outermost layer includes materials capable of increasing optical density such as toner it more frequently happens. It is found that streak defect is restrained when meniscus curvature of upper side bead becomes less than 7.2 $mm^{-1}$. This condition can be kept by selecting a proper value of clearance between the web surface and the lip of the slide hopper, that is from 0.10 mm to 0.40 mm, and a proper value of pressure in a lower side of the bead, that is from −100 Pa to −700 Pa.

10 Claims, 2 Drawing Sheets

METHOD FOR MANUFACTURING PHOTOTHERMOGRAPHIC MATERIALS

FIELD OF THE INVENTION

The present invention relates to a method for manufacturing photosensitive materials and particularly a method of manufacturing photothermographic materials by bead coating.

BACKGROUND OF THE INVENTION

Simultaneous multiple bead coating is used for manufacturing a photosensitive materials to apply multiple layers of photosensitive materials to a web. A multiple slide hopper shown in U.S. Pat. No. 2,761,791 is one of well-known coating apparatus for making simultaneous multiple coating through a bead of multiple layers formed between a lip of the multiple slide hopper, where a layered coating liquid flows by gravity on a inclined slide surface of the hopper, and a running web.

This slide bead coating can easily control a coating thickness by adjusting a web running speed and a feeding rate of coating liquid, and is suitable way for having thin layer coating which gives good photosensitive resolution and for making simultaneous multiple coating which increases productivity and decreases possibility of coating defects.

Slide bead coating, however, occasionally causes streak-like coating defect, which results in streak-like unevenness of optical density when the coated photosensitive product is used. It seems to happen more in the coating of photothermographic materials, which lowers quality of the product.

SUMMARY OF THE INVENTION

An object of the invention is to provide a coating method for manufacturing photosensitive materials, especially manufacturing photothermographic materials, with free from streak-like coating defect.

To accomplish the object studies were made and it is found that when the outer side layer includes materials capable of increasing optical density such as toner, streaks become more visible, and the streaks defect is restrained when meniscus curvature of upper side bead becomes less than a specified value. More specifically, the followings are inventions as described in the claim.

Method for manufacturing photosensitive materials comprising steps of: forming a liquid multilayer composite of a plurality of distinct layers on a slide hopper and; forming a bead of the liquid multilayer composite between a lip of the slide hopper and a running web so that an upper meniscus curvature of the bead is less than 7.2 $mm^{-1}$.

Method according to above, wherein the liquid multilayer composite includes a liquid photosensitive layer containing a silver salt of organic acid and a hydrophobic polymer latex and a liquid non-photosensitive layer containing a water-soluble polymer.

Method according to those two of above, wherein the upper meniscus curvature of the bead being less than 7.2 $mm^{-1}$ is accomplished by selecting a proper value of clearance between the web surface and the lip of the slide hopper and a proper value of pressure in a lower side of the bead.

The proper value of clearance ranges from 0.10 mm to 0.40 mm and the proper value of pressure ranges from −100 Pa to −700 Pa. The coating liquid of the photosensitive layer has thixotropy that a viscosity of the liquid shows from 300 mPa·s to 30,000 mPa·s at shear rate 0.1/s and from 1 mPa·s to 100 mPa·s at shear rate 1000/s.

DETAILED DESCRIPTION OF THE INVENTION

Figure 1:
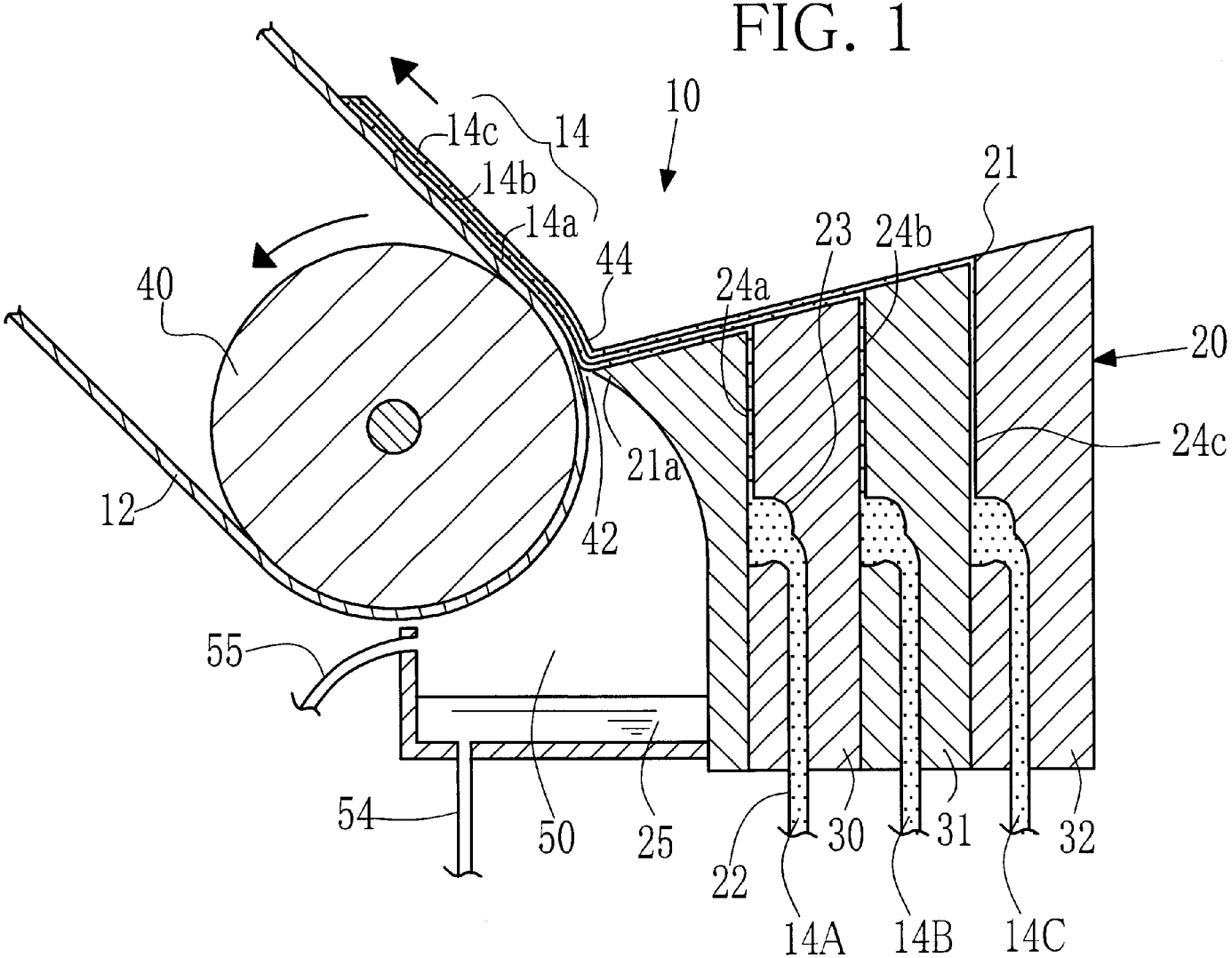
FIG. 1 is a sectional view of a multiple slide bead coating apparatus.

As shown in FIG. 1, a multiple slide bead coating apparatus 10 includes a multiple slide hopper 20 applying simultaneously multiple liquid layers to a running web 12 through a coating bead 44, a backing roller 40 to back up the web 12 and a vacuum chamber 50 to apply a reduced pressure to the coating bead 44. The multiple slide hopper 20 is constituted by a plurality of die blocks 30, 31 and 32 which are secured to each other. The multiple slide hopper 20 has slide surface 21 on its top side downwardly inclined toward the backing roller 40, over which coating liquid flows by gravity.

In the multiple slide hopper 20, the first coating liquid 14A is continuously pumped through a feeding tube 22*a* at a given rate into a cavity 23*a* from which it is extruded through a narrow vertical slot 24*a* out onto the downwardly inclined slide surface 21. The cavity 23*a* and the slot 24*a* extend across the width of the hopper 20 to cause the coating liquid 14A pumped into the cavity 23*a* to spread out across the hopper 20 and to be forced through the narrow vertical slot 24*a* in the form of a ribbon of hopper width. Other slots 24*b* and 24*c*, and cavities 23*b* and 23*c* of the multiple slide hopper 20 have the same structure and function. Second coating liquid 14B is fed into cavity 23*b* and third coating liquid 14C is fed into a cavity 23*c*. The second coating liquid 14B is superimposed on the first coating liquid 14A while flowing down the inclined slide surface and likewise the third coating liquid 14C is superimposed on the second coating liquid 14C. Those superimposed layers flow down without mixing with each other. In the example of the invention, the first coating liquid 14A is applied to form a photosensitive layer 14*a*, the second coating liquid 14B is applied to form an intermediate layer 14*b* (non-photosensitive layer), and the third coating liquid 14C is applied to form a protective layer 14*c* (non-photosensitive layer) which constitutes a photothermographic materials.

A clearance 42 is formed between the web 12 backed up by the backing roller 40 and a lip 21*a* of the slide hopper (the lowest edge portion of the inclined slide surface). The coating bead 44 including the three layered coating liquids is maintained in bridging relation between the surface of the web and the lip.

A vacuum chamber 50 for keeping a reduced pressure on a lower side of the coating bead (hereinafter referred to as a back pressure) is located lower side of the backing roller 40 and formed by being enclosed with a portion of the roller, a wall of the coating hopper leading to the lip and other covering members. Applying different pressures to the two sides of the coating bead helps bead be kept stable. The vacuum chamber 50 is connected to a vacuum pipe 52 which leads to a vacuum pump (not shown) and the degree of pressure reduction is controllable. The vacuum chamber 50 is also connected to coating liquid draining pipe 54.

Figure 2:
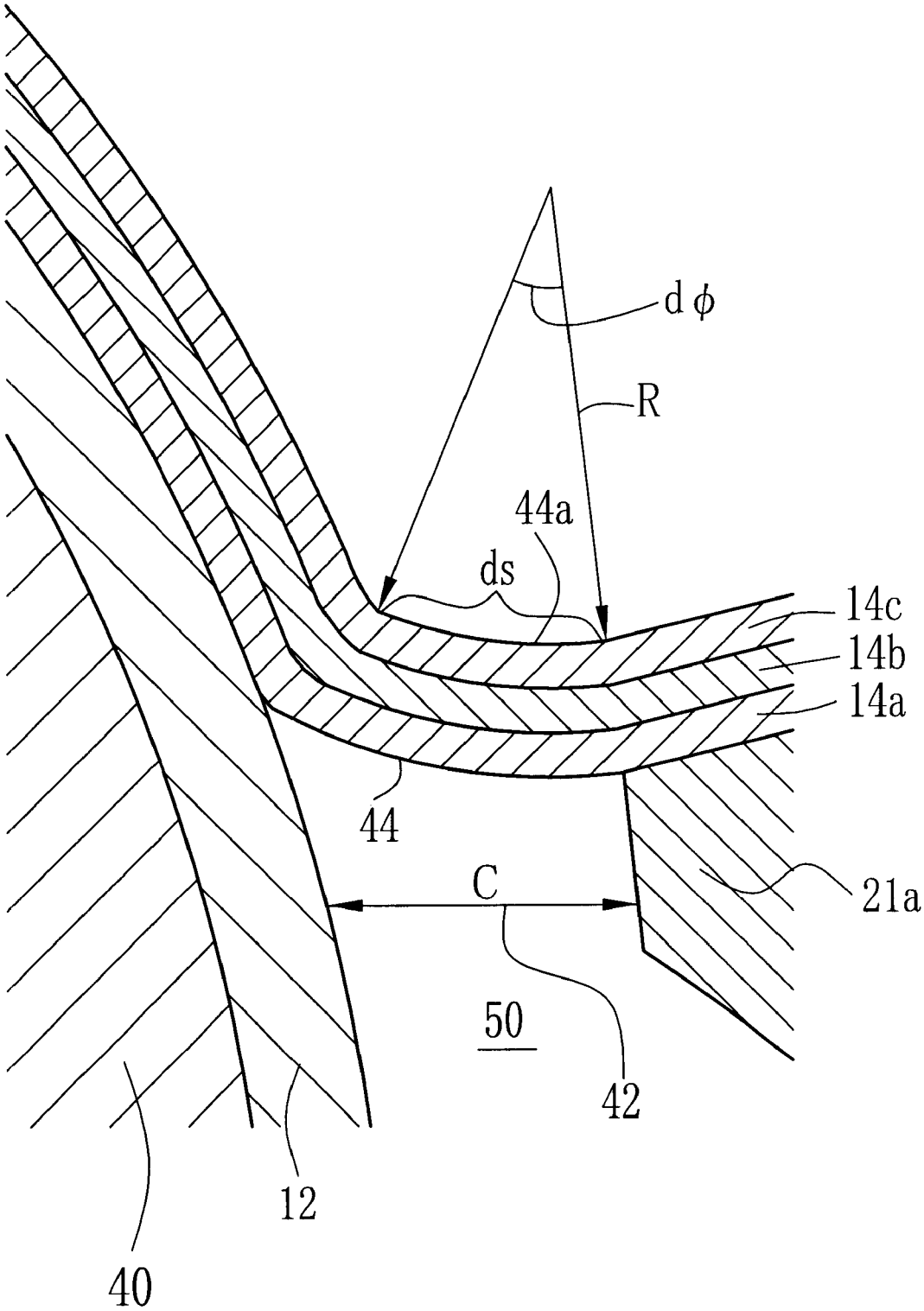
FIG. 2 is an enlarged sectional view of the coating bead.

As shown in FIG. 2, the coating bead 44, maintained in bridging relation between the running surface of the web and the lip of the hopper, has concave surface 44*a* in the upper side thereof where the protective layer 14*c* is disposed in the example. Shape of the coating bead 44 is represented by an upper meniscus curvature K which is defined as 1/R where R is a radius of curvature of the upper side concave surface 44*a*. Actual concave curve is represented by an arc of the approximate fitted circle to determine K. There is a relation $K=1/R=d\phi/ds$ where ds is length of the arc and $d\phi$ is a central angle thereof. It is found that the coating bead of which K is less than 7.2 $mm^{-1}$ gives stable coating without streak coating defect.

It is possible to make K less than 7.2 $mm^{-1}$ by controlling the clearance 42 and the back pressure. To make that, the coating clearance 42 is preferably set between 0.10 mm and 0.40 mm and the back pressure between −100 Pa and −700 Pa, more preferably the clearance is set between 0.18 mm and 0.30 mm and the back pressure between −200 Pa and −600 Pa. It is found that it can not be realized to make K less than 7.2 $mm^{-1}$ regardless of controlling the back pressure if the clearance 42 becomes less than 0.10 mm or more than 0.40 mm and it is almost impossible to make K less than 7.2 $mm^{-1}$ regardless of controlling the clearance if the back pressure becomes beyond the range above.

The following is description about a photothemographic material used in the example of the invention. Usually a photothemographic material includes a photosensitive layer and protective layer therefor. Each of those layers can consist of a plurality of layers respectively and an intermediate layer can be between the photosensitive layer and the protective one. Those layers is usually coated simultaneously on a supporting web in a superimposed relation.

The photosensitive layer generally contains a reducible silver source (e.g., organic silver salt) which is main materials to form image, a catalytic amount of a photocatalyst (e.g., silver halide), a toner for controlling the tonality of silver, and a reducing agent, typically dispersed in a binder matrix. The organic silver salt (non-photosensitive silver salt)and the reducing agent are not necessarily contained in the photosensitive layer.

The reducible silver source may comprise any material which contains a reducible source of silver ions. Silver salts of organic acids such as organic carboxylic acids, particularly long chain (from 10 to 30, preferably 15 to 28 carbon atoms) aliphatic carboxylic acids are preferred. The silver-providing compound is preferably contained in an amount of about 5–70% by weight of an image forming layer. Examples include silver salts of aliphatic carboxylic acids and silver salts of aromatic carboxylic acids though not limited thereto. Preferred examples of the silver salt of aliphatic carboxylic acid include silver behenate, silver arachidonate, acid silver stearate, silveroleate, silverlaurate, silvercaproate, silver myristate, silver palmitate, silver maleate, silver fumarate, silver tartrate, silver linolate, silver butyrate, silver camphorate and mixtures thereof. The shapes of silver salts of organic acids are not limited to any specific ones. The organic silver salt used herein is preferably desalted. The desalting method is not critical. Any well-known filtration methods and water-washing method may be used such as centrifugation, suction filtration, ultrafiltration or flocculation.

The organic silver salt is prepared into a solid microparticulate dispersion using a dispersing agent in order to provide fine grains of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, roller mills or high-pressure homogenizers. High-pressure homogenizer is particularly preferable for the purpose. The dispersing agent used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anioni polymers such as alginic acid and pectic acid; anionic surfactants as described in JPA 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropylmethyl cellulose, as well as naturally occurring high molecular weight compounds such as gelatin. Such organic silver salts are preferably used so as to provide a silver coverage of 0.1 to 5 $g/m^2$, preferably from 1 to 3 $g/m^2$.

Photosensitive silver halide is preferably used together with organic silver salt. A method for forming a photosensitive silver salt is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is preferably up to 0.20 $\mu$m, more preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. The shape of silver halide grains may be cubic, octahedral, tabular, spherical, rod-like and potato-like, with cubic and tabular grains being preferably used. Where tabular silver halide grains are used, they should preferably have an average aspect ratio of from 100:1 to 2:1, more preferably from 50:1 to 3:1.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Especially preferred is silver iodobromide preferably having a silver iodide content of 0.1 to 40 mol %, especially 0.1 to 20 mol %.

Preferably the photosensitive silver halide grains used herein contain at least one complex of a metal selected from the group consisting of rhodium, rhenium, ruthenium, osmium, iridium, cobalt, mercury and iron. The metal complexes may be used alone or in mixture of two or more complexes of a common metal or different metals. The metal complex is preferably contained in an amount of 1 nmol to 10 mmol, more preferably 10 nmol to 100 $\mu$mol per mol of silver. Illustrative metal complex structures are those described in JP-A 225449/1995. Preferred among cobalt and iron complexes are hexacyano metal complexes. Illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell. The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, palladium, and iridium and a reduction sensitization method.

Photosensitive silver halide is preferably used in an amount of 0.01 mol to 0.5 mol, more preferably 0.02 mol to 0.3 mol, most preferably 0.03 mol to 0.25 mol per mol of the non-photosensitive silver salt, typically organic silver salt.

The reducing agent for the non-photosensitive silver salt, typically organic silver salt may be any of substances, preferably organic substances, that reduce silver ion into metallic silver. Conventional photographic developing agents such as Phenidone., hydroquinone and catechol are useful although hindered phenols are preferred reducing agents. The reducing agent should preferably be contained in an amount of 5 to 50 mol %, more preferably 10 to 40 mol % per one mol of silver in an image forming layer. In a multilayer embodiment wherein the reducing agent is added to a layer other than an image forming layer, the reducing agent should preferably be contained in a slightly higher amount of about 10 to 50 mol %. Precursors capable of functioning as a reducing agent only at developing stage may be used in place of the reducing agent.

Examples of reducing agent suitable for use in photothermographic materials using organic silver salts are disclosed in Japanese Patent Applications Nos. 6074/1971, 1238/1972, 33621/1972, 46427/1974, 115540/1974, 1433419/75, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,679,426, 3,751,252, 3,751,255, 3,761,270, 3,782,949, 3,839,048, 3,928,686, 5,464,738, German Patent No. 2321328 and European Patent No. 692732.

Reducing agents may be added by any desired method in the form of solution, powder or solid microparticulate dispersion although they are preferably added in the form of a solid microparticulat dispersion using a dispersing agent. A solid microparticulate dispersion of the reducing agents may be prepared by mechanically dispersing the agent in the presence of dispersing aids by well-known comminuting means such as ball mills, vibrating ball mills, sand mills, colloidal mills, jet mills, roller mills or the like.

It is sometimes advantageous to add an additive known as a "toner" (tone adjusting agent) for improving images in addition to the aforementioned components. The toner used for controlling the tonality of silver may increase an optical density. The toner should preferably be contained in an amount of 0.1 to 50 mol %, more preferably 0.5 to 20 mol % per one mol of silver in an image forming layer. Precursors capable of functioning as a toner only at developing stage may be used in place of the toner. The toner is well known in the photographic art and examples used for photothermographics using organic silver salt are described in Japanese Patent Applications 6077/1971, 10282/1972, 5019/1974, 5020/1974, 91215/1974, 2524/,1975, 32927/1975, 67132/1975, 67641/1975, 114217/1975, 3223/1976, 27923/1976, 14788/1977, 99813/1977, 1020/1978, 76020/1978, 156524/1979, 156525/1979 and 183642/1986, 56848/1992, JP-B ("examined Japanese patent publication") 10727/1974 and 20333/1979, U.S. Pat. Nos. 3,080,254, 3,446,648, 3,782,941, 4,123,282 and 4,510,236, British Patent No. 1,380,795 and Belgium Patent No. 841,910. Toners may be added to photosensitive layer, protective layer and/or intermediate layer by any desired method in the form of solution, powder or solid microparticulate dispersion although they are preferably added in the form of a solid microparticulat dispersion using a dispersing agent.

A solid microparticulate dispersion of the reducing agents may be prepared by mechanically dispersing the agent in the presence of dispersing aids by well-known comminuting means such as ball mills, vibrating ball mills, sand mills, colloidal mills, jet mills, roller mills or the like.

Photosensitive layer used in the invention includes hydrophobic polymer latex (hereinafter referred to simply as "polymer latex") which is usually contained in an amount of more than 50% by weight of all the binder in the photosensitive layer. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. The polymer latex used herein may be either a latex of the conventional uniform structure or a latex of the so-called core/shell type. In the latter case, better results are sometimes obtained when the core and the shell have different glass transition temperatures.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex include acryl resins, vinyl acetate resins, polyester resins, polyurethane resins, rubbery resins, vinyl chloride resins, vinylidene chloride resins, polyolefin resins, and copolymers thereof. The polymers may be linear, branched or crosslinked. Further the polymer may be either a homopolymer resulting from polymerization of a single monomer or a copolymer resulting from polymerization of two or more monomers. The copolymer may be either a random copolymer or a block copolymer. The polymer preferably has a number average molecular weight of about 5,000 to 1,000,000, more preferably about 10,000 to 100,000. A polymer with a lower molecular weight would provide a photosensitive layer with insufficient mechanical strength whereas a polymer with a higher molecular weight is unlikely to form a film.

The polymer of the polymer latex used herein should have an equilibrium moisture content of up to 2% by weight, preferably 0.01 to 1% by weight, more preferably 0.03 to 1% by weight at 25° C. and RH 60%. With respect to the definition and measurement of an equilibrium moisture content, reference is made to Kobunshi Gakkai Ed., "Polymer Engineering Series 14—Polymeric Material Tests," Chijin Shokan K.K.

Illustrative examples of the polymer latex which can be used as the binder of the photosensitive layer of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers. The polymer latices may be used alone or in mixture of two or more. In the photosensitive layer, the polymer latex preferably constitutes at least 50%, especially at least 70% by weight of an entire binder. If desired, a hydrophilic polymer is added in an amount of less than 50%, preferably less than 30% by weight of the entire binder. The hydrophilic polymer may be selected from gelatin, polyvinyl alcohol (PVA), methyl cellulose, hydroxypropyl cellulose, carboxymethyl cellulose, and hydroxypropylmethyl cellulose.

The entire amount of binder of the photosensitive layer preferably used in present invention is between 0.2 and 30 g/m$^2$, more preferably between 1 and 15 g/m$^2$. Coating liquid in the photosensitive layer has a thixotropy that a viscosity of the liquid show 300 mPa·s–30,000 mPa·s at shear rate 0.1/s and 1 mpa·s–100 mPa·s at shear rate 1000/s. The viscosities were measured at 25° C. by RFS Fluid-Spectro-meter made by Rheometric Fareast KK.

Sensitizing dye, reducing agent, toner, antifoggant and other suitable additives can be added to the photosensitive layer and dyestuff, crosslinking agent and surfactant can be added to the image forming layer. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item
17643 IVA (December 1978, page 23), ibid., Item 1831 X (August 1979, page 437) and the references cited therein.

Any polymers can be used for the intermediate layer as long as the polymers have film-forming capability without causing a remarkable viscosity increase or flocculation when they contact the liquid layer including organic acid silver salts and aqueous latex binders. Water-soluble nonionic polymers are recommended for that. Examples of water-soluble nonionic polymers are polyvinyl alcohol, denaturated polyvinyl alcohol, polyacrylamide, dextran, polyethylene glycol, block copolymer of polyethylene glycol and polypropylene glycol, although polyvinyl alcohol group, particularly polyvinyl alcohol is preferable. Polyvinyl alcohol of which saponification degree is between 80 and 99.9 and polymerization degree is between 300 and 2,400 are most preferable.

Coating weight (dry) of the intermediate layer is preferably between 0.1 and 3.0 g/m$^2$, more preferably between 0.2 and 2.0 g/m$^2$. Those ranges of coating amount help improve the coating surface appearance. Less coating amount do not help, that is to say the intermediate layer does not work, and much more coating amount tends to cause adhesion problem. Namely, an excess part of the intermediate layer prevents coating the protective layer 14*c* in an adequate form, and the intermediate layer may easily be peeled off the film support in addition to increase of drying load. Further, a viscosity of the intermediate layer increases. Therefore, the surface appearance is often damaged.

Water is preferable for a coating solvent and water-miscible organic solvent can be included in a coating solvent. It is required that more than 30 weight % of coating solvent should be water and preferably more than 50 weight %, more preferably more than 70 weight % should be water. Polymer concentration should be from 2 to 20 weight % of coating solution, wet coating weight should be between 2 and 30 ml/m$^2$ and viscosity of the coating solution is preferably from 5 to 200 mPa·s at 40° C. measured by B-type viscometer (produced by Tokyo Keiki K.K.)

To the intermediate layer can be added a variety of additives such as toner and fogging agent which are compounds related to development, for example, phthalazine or ammonium phthalate.

Binders for protective layer may be dispersed in water to be coated to form a layer, typically hydrophilic polymer. Typical binders for protective layer are, for example, gelatin, polyvinyl alcohol, hydroxypropyl cellulose, methyl cellulose, hydroxypropylmethyl cellulose, hydroxyethyl cellulose, carboxymethyl cellulose, polyacrylamide, dextran. It is preferable to use gelatin, particularly delimed gelatin, as a binder for the protective layer in order to avoid mottle-like appearance defect of coating surface caused by air drying process because the gelatin can easily become gel in water solvent which has hardly fluidity.

If desired, the protective layer can be divided into two layers. In preferred embodiment, UV absorbing agent and/or hydrophobic polymer latex are added to one of two layers which is closer to a layer containing organic silver salt, and matte agent is added to the other outermost layer. If necessary, a film surface pH modifier and/or a hardening agent can be added to any of layers.

Coating amount of binder in the protective layer is between 0.1 and 3.0 g/m$^2$, preferably from 0.2 to 2.0 g/m$^2$. Viscosity of the coating liquid in the protective layer should be between 5 and 100 mPa·s at 40° C., preferably from 10 to 50 mpa·s.

The outermost protective layer preferably includes adhesion-preventing material such as wax, silica particles, styrene-containing elastomeric block copolymers (e.g., styrenebutadiene-styrene and styreneisoprene-styrene), cellulose acetate, cellulose acetate butyrate, cellulose propionate and mixtures thereof.

The photosensitive layer and other layers of the photothermographic material are formed by applying an aqueous coating solution to form a coating and drying the coating. The "aqueous" system indicates that water constitutes at least 30% by weight of the solvent or dispersing medium of the coating solution. The remainder of the solvent or dispersing medium may be a water-miscible organic solvent such as methyl alcohol, ethyl alcohol, isopropyl alcohol, methyl cellosolve, ethyl cellosolve, dimethylformamide, and ethyl acetate. The water-content should preferably be more than 50%, more preferably more than 70%.

EXAMPLE

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 9 $\mu$mol/l of dipotassium hexachloroiridate and 1 mol/l of potassium bromide were added over 30 minutes by a controlled double jet method while maintaining the solution at pAg 7.7. The solution was then desalted by lowering its pH to cause flocculation and sedimentation. Phenoxyethanol, 0.1 gram, was added to the solution, which was adjusted to pH 5.9 and pAg 8.0. There were obtained silver iodobromide grains in the form of cubic grains having a mean grain size of 0.07 μm, a coefficient of variation of projected area of 8%, and a (100) plane ratio of 86%.

The thus obtained silver halide grains were heated at 60° C., to which 85 μmol of sodium thiosulfate, 11 μmol of 2,3,4,5,6-pentafluorophenyldiphenylphosphine selenide, 2 μmol of tellurium compound (shown below), 3.3 μmol of chloroauric acid, and 230 μmol of thiocyanic acid were added per mol of silver. The solution was ripened for 120 minutes. After lowering the temperature to 40° C., $3.5\times10^{-4}$ mol of sensitizing dye A (shown below) and $4.6\times10^{-3}$ mol of 2-mercapto-5-methylbenzimidazole are added with agitation for 10 minutes and quenched to 25° C., obtaining silver halide grains.

Structural formulas of the tellurium compound and the sensitizing dye A are below:

Tellirium Compound

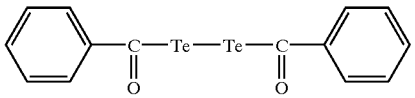

Sensitizing Compound

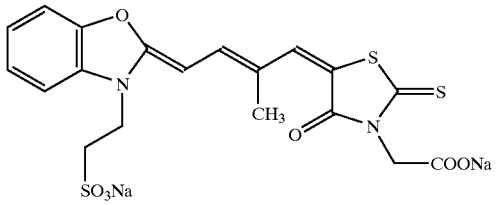

Preparation of Organic Acid Silver Salt Emulsion

A mixture of 8 g of stearic acid, 39 g of behenic acid, and 850 ml of distilled water was stirred at 90° C. With vigorous stirring, 187 ml of 1N NaOH aqueous solution was added over 120 minutes to the solution. After adding 65 ml of 1N nitric acid, the solution was cooled to 50° C. Then 125 ml of silver nitrate aqueous solution was added to the solution over 100 seconds with more vigorous stirring, and stirring was continued for 20 minutes. The solids were separated by suction filtration and washed with water until the water filtrate reached a conductivity of 30 μS/cm. To the obtained solids was added 100 g of a 10 wt % aqueous solution of hydroxypropyl cellulose and further water was added so that total weight of the mixture becomes 270 g. The mixture was coarsely dispersed by an automatic mortar and then dispersed finely by five-time-through of Manton-Gaulin homogenizer with a pressure of 560 Kg/cm$^2$, obtaining a water dispersion of organic acid silver salt of needle crystal having a mean minor axis 0.04 μm and a mean major axis 0.9 μm, and a coefficient of variation 30%.

Preparation of Dispersion of Reducing Agent

Water in amount of 850 g was added to and thoroughly mixed with 100 g 1001,1-bis(2-hydroxy-3,5-dimethylphenyl)-3,5,5-trimethylhexane and 50 g of hydroxypropylmethyl cellulose, thereby obtaining a slurry. This slurry and 840 g of zirconia beads having an average diameter of 0.5 mm were placed together in a vessel, and underwent a dispersing operation over a period of 5 hours by means of a dispersing machine (¼G Sand Grinder Mill, produced by Imex K. K.) to prepare a dispersion of reducing agent.

Preparation of Dispersion of Organic Polyhalogenated Compound.

Water in amount of 940 g was added to and thoroughly mixed with 50 g of tribromomethylphenylsulfone and 10 g of hydroxypropyl cellulose, thereby obtaining a slurry. This slurry and 840 g of zirconia beads having an average diameter of 0.5 mm were placed together in a vessel, and underwent a dispersing operation over a period of 5 hours by means of a dispersing machine (¼G Sand Grinder Mill, produced by Imex K. K.) to prepare a dispersion of organic polyhalogenated compound.

Preparation of Photosensitive Layer Coating Solution

Dispersion of organic acid silver salt in amount of 100 g, 8 g of water, 23 g of dispersion of reducing agent, 14 g of dispersion of organic polyhalogenated compound, 109 g of Lacstar (SBR latex produced by DaiNihon Ink Chemical K.K.), 17 g of 5 weight % water solution of phthalazine compound and 15 g of silver halide grain were all put together and thoroughly mixed to prepare a photosensitive layer coating liquid.

The viscosity of the coating liquid in the photosensitive layer showed 500, 70, 50, 20, 15 mPa·s at shear rate 0.1, 1.0 10, 100, 1000 [1/sec] in the order named. The viscosity was measured at 25° C. by RFS Fluid-Spectro-meter made by Rheometric Fareast KK.

Polyvinyl alcohol PVA-205 (trade name, product of Kuraray Co., Ltd.) 20 weight % water solution in amount of 200 g, 172 g of Sebian A (Daicell Chemical Industry K.K.), 1 g of 5 weight % water solution of Aerosol OT (produced by American Cyanamide Inc.) and 5 g of 20 weight % of water solution of ammonium phthalate were put together and mixed to prepare a coating liquid in the intermediate layer. The viscosity of the thus prepared coating solution was 36 mPa·s at 40° C., measured by No.1 rotor of B-type viscometer (made by Tokyo Keiki).

Preparation of Coating Solution for First Protective Layer

Alkali-treated gelatin in amount of 100 g was dissolved in 880 g of water. Then 5 ml of Aerosol OT, 47 ml of 15 weight % methanol solution of phthalic acid and 181 g of Sebian A are added to the solution to prepare the coating liquid in the first protective layer. The viscosity of the thus prepared coating solution was 14 mPa·s at 40° C., measured by B-type viscometer.

Preparation of Coating Solution for Second Protective Layer.

Alkali-treated gelatin in amount of 100 g was dissolved in 844 g of water, and thereto were added 4 ml of 5 weight % solution of potassium salt of N-perfluorooctylsulfonyl-N-propylalanine, 45 ml of 2 weight % solution of polyethyleneglycolmono(N-perfluorooctylsulfonyl-N-propyl-2-aminoethyl) ether, 28 ml of 5 weight % solution of Aerosol OT (American Cyanamide Inc.), 115 g of polymethyl methacrylate fine particles, 39 ml of 15 weight % solution of phthalic acid and 181 g of Sebian A. The thus prepared mixture was employed as a coating solution for a second protective layer. The viscosity of the thus prepared coating solution was 16 mPa·s at 40° C., measured with the foregoing B-type viscometer (No.1 rotor).

Making Samples of Photothermographic Film.

Coating liquid in the photosensitive layer, the intermediate layer, the first and second protective layers are coated in the order on a web of polyethylene terephthalate film with subbing of polyester. Multi-slide hopper for four layers were used. (Another one block was added to multi-slide hopper shown in FIG. 1 to form another cavity and slot for fourth layer (second protective layer)). Thickness of the web was 175 $\mu$M.

Coating Condition.

Coating speed: 100 m/min.

Coating width: 150 mm

Coating wet amount (thickness):

photosensitive layer; 67 ml/m$^2$($\mu$m)

intermediate layer; 10 ml/m$^2$($\mu$m)

first protective layer; 18 ml/m$^2$($\mu$m)

second protective layer; 8 ml/m$^2$($\mu$m)

Temperature setting:

coating liquid for photosensitive layer; 32° C.

for intermediate layer; 32° C.

for first protective layer; 40° C.

for second protective layer; 40° C. hopper block; 35° C.

Evaluation of Coating Surface Appearance.

After developing of the coated samples, the number of visible streak was counted. Developing temperature was 120° C. and developing time was 20 seconds. Table 1 shows a relation between the upper meniscus curvature K and emergence of streak.

TABLE 1

| sample No. | coating clearance (mm) | back pressure (Pa) | upper meniscus curvature K (mm$^{-1}$) | the number of visible streak (–) |
|---|---|---|---|---|
| 1. | 0.15 | −392 | 7.41 | 13 |
| 2. | 0.19 | −392 | 7.29 | 16 |
| 3. | 0.19 | −196 | 7.11 | 0 |
| 4. | 0.23 | −392 | 7.11 | 0 |
| 5. | 0.23 | −783 | 7.41 | 5 |

Table 1 indicates that visible streak defect emerges when the upper meniscus curvature K becomes more than 7.2 mm$^{-1}$ and the curvature K can be controllable by coating clearance and back pressure of the coating condition.

What we claim is:

1. Method for manufacturing photosensitive materials comprising steps of:

forming a liquid multilayer composite of a plurality of distinct layers on a slide hopper; and forming a bead of the liquid multilayer composite between a lip of the slide hopper and a running web so that an upper meniscus curvature of the bead is less than 7.2 mm$^{-1}$.

2. Method according to claim 1, wherein the liquid multilayer composite comprises a liquid photosensitive layer comprising a silver salt of organic acid and a hydrophobic polymer latex, and a liquid non-photosensitive layer comprising a water-soluble polymer.

3. Method according to claim 1, wherein the upper meniscus curvature of the bead being less than 7.2 mm$^{-1}$ is accomplished by selecting a proper value of clearance between the web surface and the lip of the slide hopper and a proper value of pressure in a lower side of the bead.

4. Method according to claim 3, wherein the proper value of clearance ranges from 0.10 mm to 0.40 mm and the proper value of pressure ranges from −100 Pa to −700 Pa.

5. Method according to claim 4, wherein the liquid in the photosensitive layer has thixotropy that a viscosity of the liquid becomes between 300 mPa·s and 30,000 mPa·s at shear rate 0.1/s and between 1 mPa·s and 100 mPa·s at shear rate 1000/s.

6. Method according to claim 2, wherein the upper meniscus curvature of the bead being less than 7.2 mm$^{-1}$ is accomplished by selecting a proper value of clearance between the web surface and the lip of the slide hopper and a proper value of pressure in a lower side of the bead.

7. Method according to claim 6, wherein the proper value of clearance ranges from 0.10 mm to 0.40 mm and the proper value of pressure ranges from −100 Pa to −700 Pa.

8. Method according to claim 7, wherein liquid in the photosensitive layer has a thixotropy that viscosity of the liquid is between 300 mPa·s and 30,000 mPa·s at shear rate 0.1/s and between 1 mPa·s and 100 mPa·s at shear rate 1000/s.

9. Method according to claim 8, wherein viscosity of liquid in said non-photosensitive layer is between 5 and 100 mPa·s at 40° C.

10. Method according to claim 2, wherein the liquid non-photosensitive layer further containing toner.

* * * * *